United States Patent [19]

Murphy et al.

[11] Patent Number: 4,719,778

[45] Date of Patent: Jan. 19, 1988

[54] KEY RING SEPARATOR

[76] Inventors: Hildegarde J. Murphy; Milo E. Murphy, both of 2299 Ximeno Ave., Long Beach, Calif. 90815

[21] Appl. No.: 832,646

[22] Filed: Feb. 24, 1986

[51] Int. Cl.[4] ..... B25B 33/00

[52] U.S. Cl. ..... 70/456 R; 70/408; 70/458

[58] Field of Search ..... 70/408, 456 R, 458; D3/61, 62; 24/3 K, 3 R

[56] References Cited

U.S. PATENT DOCUMENTS

| | | | |
|---|---|---|---|
| 603,247 | 5/1898 | Becker | 70/458 |
| 739,094 | 9/1903 | Lewis | 70/458 |
| 1,462,205 | 7/1923 | Korns | 70/458 |
| 2,451,091 | 10/1948 | Johnson | 70/456 R |
| 3,315,504 | 4/1967 | Billings | 70/458 X |
| 3,481,169 | 12/1969 | Rossi | 70/456 R X |
| 4,176,534 | 12/1979 | Denney | 70/459 X |
| 4,325,273 | 4/1982 | Gibbons | 70/456 R X |
| 4,543,860 | 10/1985 | Van Meter | 70/456 R X |

FOREIGN PATENT DOCUMENTS

| | | | |
|---|---|---|---|
| 1098583 | 8/1955 | France | 70/456 R |

*Primary Examiner*—Robert L. Wolfe
*Assistant Examiner*—Suzanne L. Dino
*Attorney, Agent, or Firm*—I. Michael Bak-Boychuk

[57] ABSTRACT

A triangular, sharp projection is formed in the surface of a key handle, the projection being directed into the interior of a key ring opening formed therein. This key ring projection includes edge recesses formed proximate the base thereof thereby providing a shape forcing the segments of a collapsed helical key ring apart, the recesses then maintaining the ring segments separated for insertion or removal of additional keys. In an alternative implementation the similar key ring separation projection may be formed on articles other than keys that can thus be carried on the key ring for convenience in key removal.

1 Claim, 6 Drawing Figures

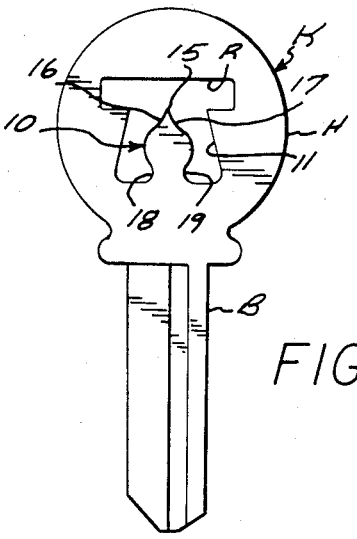
FIG. 1
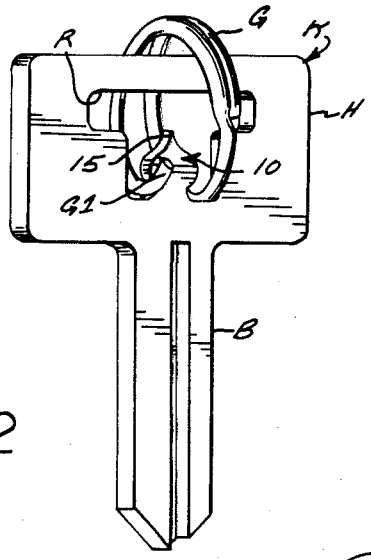
FIG. 2
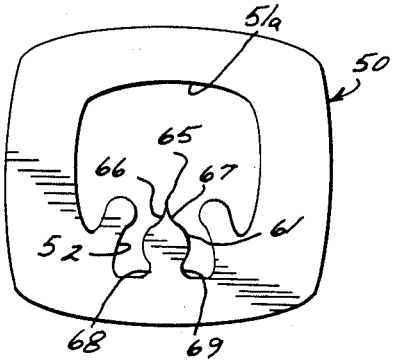
FIG. 3
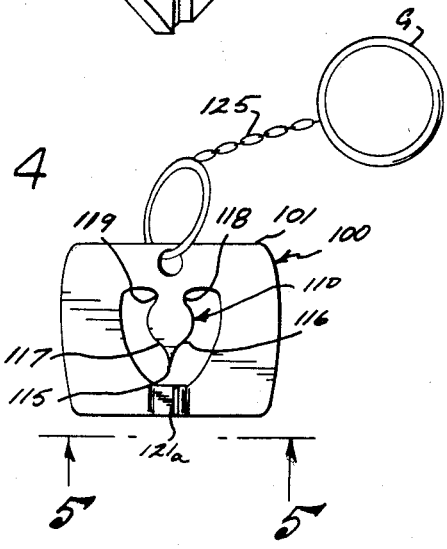
FIG. 4
FIG. 5
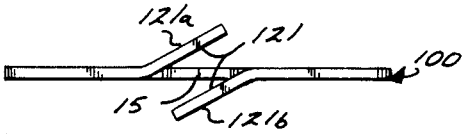
FIG. 6
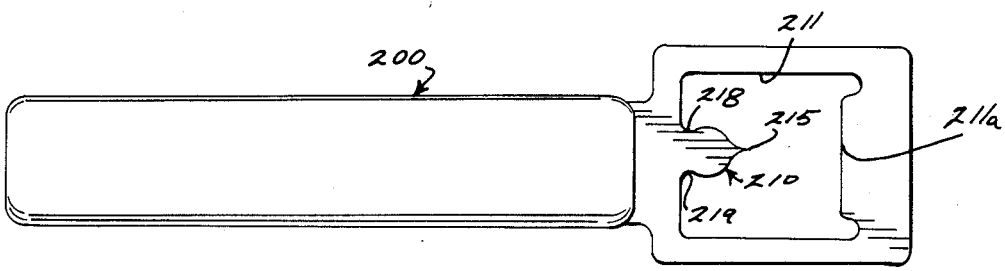

KEY RING SEPARATOR

BACKGROUND OF THE INVENTION

1. Field of the Invention

The present invention relates to key ring separation devices, and more particularly, key devices conformed to separate the collapsed segment of a helical key ring.

2. Description of the Prior Art

Devices for storing keys have taken various forms of which the most inexpensive is a key ring convolved in the manner of a collapsed helical coil. Typically, such key rings are formed of spring steel materials with the ends of the coils prestressed for intimate contact. For a further convenience the coil of the key rings thus formed often include an S bend approximate the center thereof to accommodate the thickness of the coil ends and the insertion and removal of the keys from and onto such a key ring are therefore difficult.

Accordingly, the interests of secure engagement of the keys on a key ring quite often render the removal and insertion of the keys difficult for use. In the past, various accommodations have been devised to solve this problem, accommodations typically in the form of a tortuous paths from the exterior edge of the key to the key ring opening. Typical of such solutions are the teachings of U.S. Pat. Nos. 3,481,169 and 3,315,504, respectively to Rossi and Billings, Jr. These solutions, while suitable for their purpose, nevertheless entail the possible loss of a key from the key ring, and, more importantly, rely on the consistency of the sectional dimension of the ring itself.

The process of insertion or removal of a key from a helical key ring entails the most difficulty in the manipulative task of separating the key ring ends. Once the ends are sufficiently separated to allow the insertion of the key therebetween the remainder of the separation sequence is both convenient and self effecting. Thus, techniques for convenient separation of the key ring coils have been sought in the past and it is one such technique that is disclosed herein.

SUMMARY OF THE INVENTION

Accordingly, it is the general purpose and object of the present invention to provide a key ring separating structure forming a part of the key itself.

Other objects of the invention are to provide the functional shape to the ring opening of a key by which the ends of a helical key ring may be separated.

Yet additional objects of the invention are to provide a key ring separating shape which may form part of various articles.

Briefly, these and other objects are accomplished within the present invention by providing a cut-out in the surface of the key handle to form a generally pointed triangular projection directed into the interior of the ring opening of the key. This projection is generally defined by two concave edges joined at an apex or point and expanding at the base of a triangular plan form to urge the separated coils into two opposed recesses. Thus, the separator shape offers a sharp point or edge which may be pressed between the bound or collapsed coils of a helical spring and which upon further insertion will separate such coils. Once the shape or projection is inserted to a depth where the ring segments pass into the opposed recesses the ring is fixed in its separated form, exposing one or the other end thereof for receiving or withdrawing of a key.

In alternative implementation the ring separating projections may be formed as part of an article like a bottle opener and may form a separate structure carried on the ring. In each instance, however, the sharp end of the separator is aligned in the plane of the structure within which it is formed, thus protecting the user from inadvertent injury.

In this manner a convenient separation mechanism is provided which may be part of the key itself or which may be separately vended. Thus, a task heretofore difficult to perform is simplified with minimal expenditure of costs or materials.

BRIEF DESCRIPTION OF DRAWINGS

FIG. 1 is a plan view of a prior art ring with a key including in the structure thereof an inventive ring separating projection;

FIG. 2 is a perspective illustration of a key shown in FIG. 1 in the course of separation of a key ring;

FIG. 3 is an alternative implementation, in the shape of a disc of the key ring separator constructed according to the present invention;

FIG. 4 is yet another alternative implementation as a key ring separator constructed according to the invention herein;

FIG. 5 is an end view taken along the line 5—5 of FIG. 4; and

FIG. 6 is a functional article conformed to include the ring separator projection constructed according to the invention herein.

DESCRIPTION OF THE PREFERRED EMBODIMENT

As shown in FIGS. 1 and 2 a conventional key K typically includes an insertable key blade B extending from one edge of a key handle H which is usually provided with a key ring hole or opening R. Typically keys in this form are made from a single sheet metal stamping, stamped in large multiples as key blanks. Once such key blanks are thus formed one or more edges of the blade B are then convolved to the appropriate keying shape to operate a lock.

As a consequence the key blank itself represents an inexpensive structure reproduced in large multiples with minimal tooling. This inexpensive structure is then available to the members of the public who typically store it on the key rings most often in the form of a collapsed helical coil. For this reason the key blank K includes the foregoing ring opening R which is punched in the course of the production of the blank.

By a convenient modification of the punch die the ring opening R may be conformed to include a pointed ring separator projection 10 formed centrally within a trapezoidal cut-out 11 communicating a the upper edge with the ring opening. The projection 10 is generaly of a triangular plan form having the apex 15 thereof directed into the ring opening. This apex 15 is defined by the intersection of two concavely curved edges 16 and 17 which expand therefrom to fair into two opposed recesses 18 and 19 at the base of the projection. Each of the recesses 18 and 19, moreover, is shaped to define a space larger than the sectional dimension of the coils of a collapsed helical coil ring G.

Accordingly, the sharp apex of the projection 10 may be used to force apart the collapsed coil sections of the ring G and once such are forced apart the separated ring may then be advanced to drop into the opposed recesses 18 and 19. Once thus separated the end of the coil G1 is then presented for receipt or withdrawal of additional keys. One should note that the structure thus defined will maintain the ring coil separated by the spring tension therebetween. Simply, the coil segments received in recesses 18 and 19 will maintain the projection 10 in position and the ring thus separated may then be advanced by sliding the projection between the coils.

An alternative implementation of the foregoing invention may be carried out in accordance with the teachings of FIG. 3. In this form a disc 50 may be stamped from any conventional sheet metal shock, such disc 50 including a central enlarged ring opening 51*a* which, again, is expanded by way of the trapezoidal cut-out 52 within which a projection 61 similarly shaped to the projection 10 extends. Once again, projection 61 includes an apex 65 shaped like the apex 15 by the juncture of concave edged shapes 66 and 67. In a manner similar to that shown in FIGS. 1 and 2 the base of the projection 61 may be defined by two inwardly directed recesses 68 and 69 serving the same function as recesses 18 and 19 previously described.

In this form disc 50 may be carried as part of the complement of articles carried on the ring G for the occasional use of separating the ring coils to extract keys by the features hereinabove described.

Yet a further alternative may be constructed in accordance with the teachings of FIGS. 4 and 5. As shown in these figures a separation device 100 may be formed, once again, of sheet metal structure including at one edge thereof, a folded-over manipulative ledge 101. This ledge provides an opposing shoulder for a similarly constructed separation projection 110 formed within a trapezoidal cut out 111 in the remaining portion of the sheet metal structure 100. Once again, projection 110 includes the sharp apex 115 defined by the juncture of two concave edges 116 and 117 which fair into the opposed recesses 118 and 119 to function in a manner similar to that described hereinabove. In this instance, however, the separator assembly includes a communicating path or gap into the trapezoidal cut-out from the exterior shown as gap 121 which is formed by cutting the sheet metal structure from the exterior to the trapezoidal cut-out and bending over the cut edges to define the gap. Specifically, gap 121 is formed between the bent-up edge 121*a* and the bent-down edge 121*b* on either side thereof which, again, form a structural closure in direct opposition to the pointed apex 115. Thus, similar to the teachings above, the sharp apex necessary to separate the ring coil is enclosed by the structure of the device to protect the user from injury or harm. This structure 100 may then be carried on a chain 125 which, in turn, may then be connected to or attached to the key ring G for convenient use.

A further alternative, shown in FIG. 6, combines the foregoing ring separating structure with a functional device like a bottle opener. Specifically, the trapezoidal cut-out in this instance shown as cut-out 211, is formed within a rectangular sheet metal plates having along one edge of the cut-out overhanging lip 211*a* to function as a bottle opener. Opposite lip 211*a* and directed towards it is the ring separating projection 210, once again, including an apex 215 and recesses 218 and 219 to function in accordance with the above teachings. This bottle opening structure 200 is then carried on the ring in a manner previously described and is thus available to serve multiple functions for the user.

Obviously many modifications and changes may be made to the foregoing description without departing from the spirit of the invention. It is therefore intended that the scope of the invention be determined solely on the claims appended hereto.

What is claimed is:

1. A planar sheet structure for separating the collapsed coils of a key ring, comprising:

a generally triangular structure projection including an apex defined by the intersection of two arcuate concave sides each extending from said apex to a corresponding one of two opposing recesses separated by a base connection of a key ring carried object, each said recess being conformed to receive a coil of said key ring; and a peripheral edge strip surrounding said structural projection, said edge strip including a passageway being defined by two opposed outwardly bent edge members separated by a dimension greater than the sectional dimension of said key ring.

* * * * *